United States Patent [19]

Donatello et al.

[11] Patent Number: 4,699,318

[45] Date of Patent: Oct. 13, 1987

[54] DRINKING APPARATUS

[76] Inventors: Mike A. Donatello, 4205 N. Monitor Ave., Chicago, Ill. 60634; Scott N. Moritz, 15337 Summit Ave., Villa Park, Ill. 60181; Guy L. Shuman, 5819 N. Mason Ave., Chicago, Ill. 60646

[21] Appl. No.: 819,016

[22] Filed: Jan. 15, 1986

[51] Int. Cl.[4] ..... A47G 19/22

[52] U.S. Cl. ..... 239/33; 220/90.2; 215/1 A; 215/100 R; D7/42

[58] Field of Search ..... 239/33; 215/1 A, 100 R, 215/229; 220/90.2; 229/7 S; D7/42

[56] References Cited

U.S. PATENT DOCUMENTS

| | | | |
|---|---|---|---|
| 2,052,307 | 8/1936 | Kennedy | 215/229 X |
| 2,460,542 | 2/1949 | Smith | 239/33 X |
| 2,558,645 | 6/1951 | Docter | 239/33 |
| 4,196,747 | 4/1980 | Quigley et al. | 239/33 X |
| 4,462,544 | 7/1984 | Rutzel et al. | 239/33 |

FOREIGN PATENT DOCUMENTS

| | | | |
|---|---|---|---|
| 2421990 | 11/1975 | Fed. Rep. of Germany | 220/90.2 |

*Primary Examiner*—Andres Kashnikow
*Assistant Examiner*—MaryBeth O. Jones
*Attorney, Agent, or Firm*—Wood, Dalton, Phillips, Mason & Rowe

[57] ABSTRACT

A drinking apparatus for enabling more than one person to simultaneously drink a liquid which is being held in a container. The drinking apparatus includes a plurality of tubes, the tubes being secured to a base member. Each of the tubes can be used, simultaneously, to drink the liquid, in much the same fashion as a straw is used.

18 Claims, 4 Drawing Figures

DRINKING APPARATUS

FIELD OF THE INVENTION

This invention relates generally to a drinking apparatus and more particularly to an apparatus for enabling more than one person to simultaneously drink a liquid from a container.

BACKGROUND OF THE INVENTION

Many ways have been used by individuals to drink a liquid, such as a beverage. For example, one may raise a glass containing the beverage to one's mouth or alternatively, use a straw like device inserted in the beverage to draw the beverage upwardly from the glass. Each of these drinking means may be less than desirable when a group of people is sitting around a table enjoying the beverage along with conversation.

When the beverage is served in a pitcher, the beverage must subsequently be poured into individual glasses for each person drinking. This pouring increases the likelihood of spills, as well as causing a carbonated beverage to loose its carbonation. Additionally, each drinker must continually raise his or her glass in order to consume the beverage.

One way to lessen the above problems is for each person to drink out of a single pitcher using individual straws. Hereagain, many problems will arise. Straws which are too short may become completely submerged in the liquid, while a straw of any length is generally forced up out of the liquid with a carbonated beverage. More importantly, there is a sanitation problem when several persons use straws to drink out of a single pitcher.

The present invention is intended to overcome these and other problems with prior art drinking devices.

SUMMARY OF THE INVENTION

It is an object of this invention to provide a drinking apparatus for enabling more than one being to simultaneously imbibe a fluid which is held in a container.

More specifically, the drinking apparatus includes a base member which has a size and shape so that it may be positioned in the container. Also included are a plurality of tubular members. Means are associated with the base member for securing the tubular members to the base member whereby suction imparted on an upper end of the tubular members causes the fluid in the container to pass up through the tubular members enabling imbibing of the fluid.

Another object of this invention is to provide a base member which is removably mounted in the container.

Yet another object of the present invention is to alternately use a base member which is fixedly attached to the container.

Sill another object of the present invention is to provide means in the tubular members for only permitting the fluid to flow in one direction through the tubular member.

Yet a further feature of the persent invention is to provide a retaining member for positioning the tubular member along an upper rim of the container.

DETAILED DESCRIPTION OF THE PREFERRED EMBODIMENTS

Figure 1:
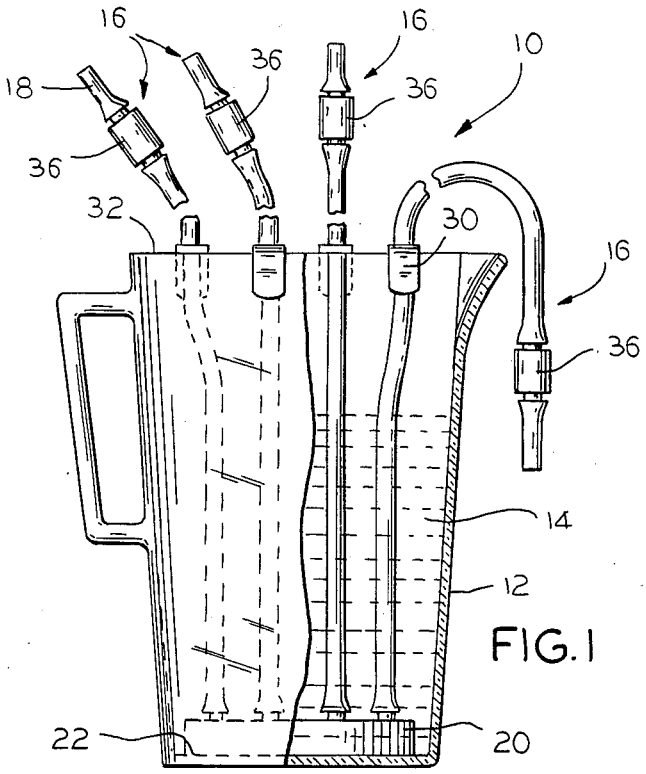
FIG. 1 is a perspective view illustrating an embodiment of the present invention.

Referring first to FIG. 1, an embodiment 10 of the present invention is illustrated in conjunction with a container 12 in the form of a pitcher. The drinking apparatus 10 enables from one to four people to drink a liquid 14 contained in the pitcher 12 either individually or simultaneously.

The drinking apparatus 10 includes a plurality of tubular members 16. In the embodiment shown four tubular members 16 are provided although a greater or lesser number could be provided as necessary or desired. Since each tubular member 16 is identical in construction only one will be discussed in detail.

In usage when a drinker sucks on an upper tube or end portion 18 of the tubular member 16 the resulting suction causes the fluid 14 to be drawn up through the tubular member 16. It is thus possible for the fluid 14 to be imbibed at will by the drinker. Moreover, when four tubular members 16 are provided, as in the illustrated embodiment, as many as four drinkers could imbibe the fluid 14 simultaneously.

Figure 2:
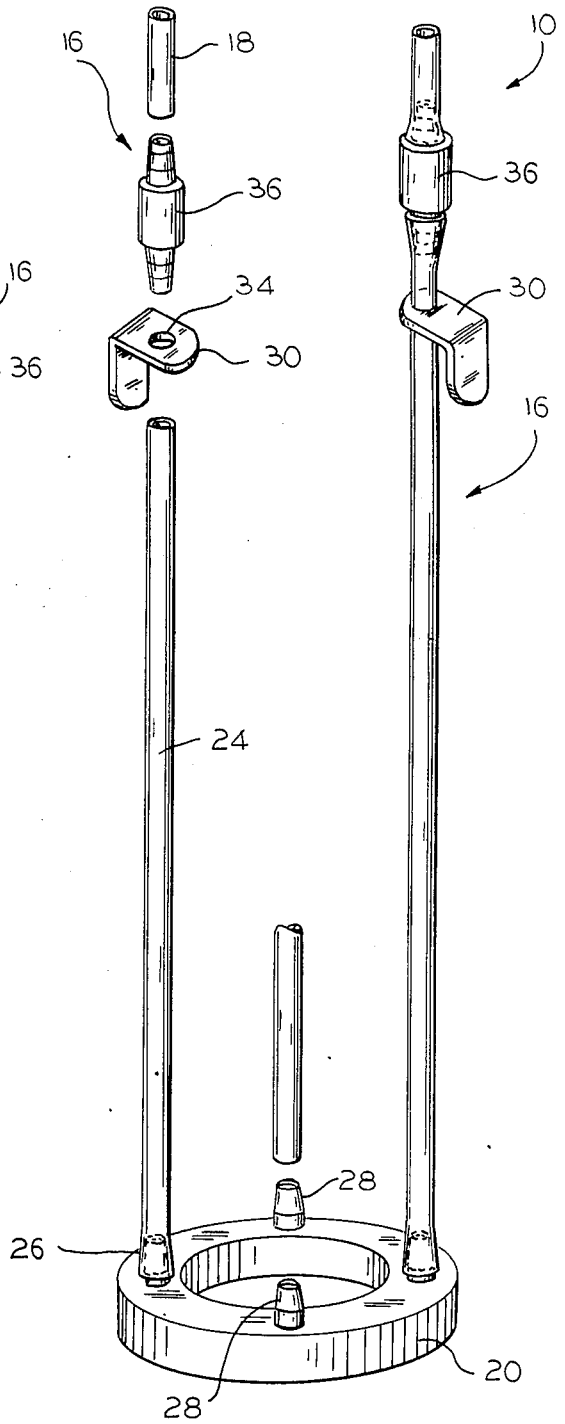
FIG. 2 is a partially exploded perspective view of the apparatus of the present invention removed from its associated container.

Referring now to FIG. 2, the drinking apparatus 10 is shown removed from the pitcher 12, in a partially exploded perspective view.

The drinking apparatus 10 includes a vacuum ring or base member 20 which is to be positioned inside and adjacent a bottom portion or wall 22 of the pitcher 12. The tubular member 16 includes a primary tube 24 which is a hollow somewhat flexible tube intended to function in much the same fashion as a drinking straw. The primary tube 24, however, is constructed of a material such as a durable soft plastic to allow for long life of the drinking apparatus 10. Such a tube 24 should be able to withstand continual use, as well as being washed at high temperatures for sanitization purposes.

The upper tube 18 is generally selected of a material similar to that of the primary tube 24, although such is not required. Additionally, the upper tube 18 and the primary tube 24 could be a single tube extending upwardly from the vacuum ring or base member 20.

The primary tube 24 includes a lower end 26 secured to the base member 20. In the embodiment shown the base member 20 includes four nipples 28, one for each of the four tubular members 16. The lower end 26 of each of the primary tubes 24 slides over one of the nipples 28 so that it is firmly held in position. If it is desired to replace a tubular member 16, the lower end 26 could be removed from its associated nipple 28, and thereafter be replaced. Additionally, the primary tube 24 could be secured to the nipple 28 by an adhesive, ultrasonic welding or any other known means if removal is not necessary.

While the base member 20 shown utilizes protruding nipples 28 to secure the tubular members 16, the base member 20 could alternately be provided with a plurality of apertures (not shown) through which the tubular members could be inserted in a force fit or still other means for connecting the tubular members 16 to the base member 20 could be utilized.

Positioned on the primary tube 24 is an L-shaped bracket 30 for holding the tubular member 16 in position on an upper edge 32 of the pitcher 12, as shown in FIG. 1. The L-shaped bracket 30 includes an opening 34 through which the primary tube 24 is inserted. The L-shaped bracket 30 may be slidably mounted on the primary tube 24 or alternately may be secured in a fixed position by any known means.

To render the drinking apparatus 10 sanitary, a check valve 36 is provided for each tubular member 16. The check valve 36 is located between the upper tube 18 and the primary tube 24. Where only a single tube is used the check valve 36 is inserted in the tube. The check valve 36 enables the fluid 14 to flow through the tubular member 16 in a direction from the primary tube 24 to the upper tube 18. Conversely, the liquid cannot flow in the direction from the upper tube 18 to the primary tube 24. The check valve 36 thus prevents saliva, or liquid which has touched a drinker's mouth from returning to the pitcher 12. The use of the check valve 36 thus minimizes the possibility that a disease may be passed from one drinker to another.

When desirable, such as to save on costs, the L-shaped bracket 30 may be integrally affixed to the check valve 36 at the time of manufacturing.

Figure 3:
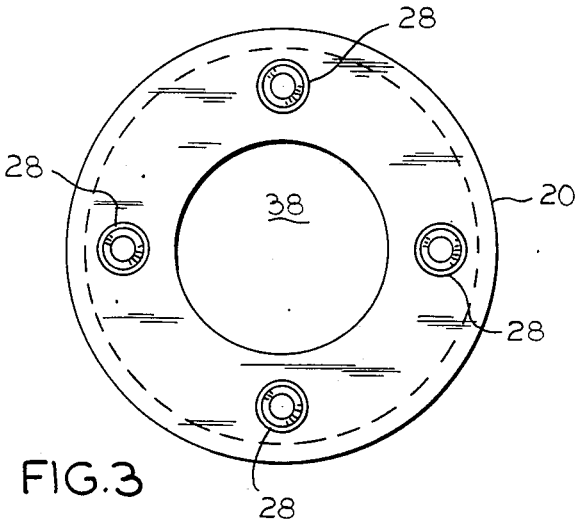
FIG. 3 is a plan view of a base member of the present invention.
Figure 4:
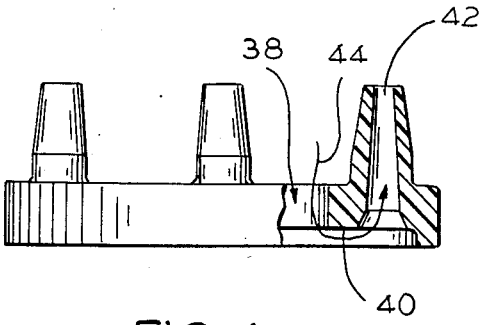
FIG. 4 is a partially cutaway elevational view of the base member.

Referring now to FIG. 3, the vacuum ring or base member 20 is shown. The perimeter of the base member 20 is circular to coincide with the shape of the bottom portion 22 of the pitcher 12. However, when a different size or shape container is utilized the size and shape of the base member 20 may be modified accordingly.

In the embodiment illustrated, the base member 20 includes a central opening 38, and an inset portion 40 on its underside. Each of the nipples 28 is located circumferentially around the base member 20 along the inset portion 40 and includes a central opening 42 through which the liquid will flow prior to entering the primary tube 24. When the base member 20 is submerged in the fluid 14 with suction placed on the tubular member 16, fluid 14 flows through the central opening 38, under the inset portion 40 and upwardly through the opening 42 of the nipple 28, as indicated by an arrow 44. The liquid 14 then proceeds through the tubular member 16 whereby it may be imbibed.

The base member 20 may be machined or molded, and is constructed using an FDA approved food grade material. The weight of the base member 20 is selected so that the base member 20 will remain at the bottom of the pitcher 12 even when a carbonated liquid is used.

To eliminate possible confusion and distinguish between the individual tubular member 16, the upper tubes 18 may be coded, such as with different colors, to prevent one drinker from using a tubular member previously used by another drinker.

In the embodiments shown in FIGS. 1 through 4 the drinking apparatus 10 is shown removably mounted in the pitcher 12. However, the base member 20 can be molded and formed as part of the pitcher 12 so that the drinking apparatus 10, or a variation thereof incorporating the concept of the invention, is permanently secured in the pitcher 12. In this alternate embodiment, the construction of the tubular member 16 would be similar to that discussed previously.

Certain other variations of the disclosed invention will be readily apparent to one skilled in the art.

We claim:

1. A device for simultaneously enabling more than one person or being to imbibe a fluid, the fluid being held in a container, comprising:

a plurality of tubular members;

a base member of a size and shape to be positioned in the container beneath the level of the liquid, the base member including a central opening and an inset portion on its underside adjacent the central opening; and means associated with the base member for securing the tubular members to the base member whereby fluid in the container may pass through the central opening and inset portion of the base member and thereafter through the tubular members due to suction imparted on the tubular member so as to enable imbibing of the fluid.

2. The device defined by claim 1 wherein the base member is removably mountable in the container.

3. The device defined by claim 1 wherein the base member is fixedly attached to the container.

4. The device defined by claim 1 further comprising means for permitting the fluid to flow through the tubular member in only one direction.

5. The device defined by claim 1 wherein the base member is of sufficient weight so that the base member will remain at the bottom of the container when the container is filled with a liquid.

6. A device for enabling two or more persons to simultaneously drink a fluid which is being held in a container, the drinking device comprising:

at least two tubular members;

a vacuum ring member of a size and shape corresponding to the size and shape of the inside of the container, the vacuum ring member including a central opening therethrough and an inset portion on its underside;

means for securing the tubular members to the vacuum ring member;

each of the tubular members having a first end secured to the vacuum ring member;

each of the tubular members having a second end adapted for suction to be imparted by a person when the vacuum ring member is placed in the container with fluid therein to cause the fluid to pass through the central opening and inset portion of the vacuum ring member and thereafter the tubular member;

whereby more than one person is enabled to drink the fluid from the container simultaneously.

7. The drinking device defined by claim 6 wherein the vacuum ring member is removably mounted in the container.

8. The drinking device of claim 6 wherein the vacuum ring member is an integral part of the container.

9. The drinking device defined by claim 6 wherein the vacuum ring member has a plurality of nipples and the securing means comprises the tubular members being force fit on the nipples.

10. The drinking device defined by claim 6 further including means for permitting fluid to flow through the tubular members only in the direction from the first end to the second end.

11. The drinking device defined by claim 10 wherein the flow permitting means comprises a check valve provided for each tubular member.

12. The drinking device defined by claim 6 further comprising a plurality of bracket members for positioning the tubular members with respect to the container.

13. The drinking device defined by claim 6 wherein the vacuum ring member is of a sufficient weight so that the vacuum ring member will remain at the bottom of the container when the container is filled with a liquid.

14. The drinking device defined by claim 6 wherein the vacuum ring member further comprises at least two longitudinal openings therethrough in communication with the securing means and the inset portion for enabling fluid to flow from the container into the tubular members.

15. A container for simultaneously enabling more than one person to drink a fluid held in the container, the container comprising:

an outer wall;

a bottom wall secured to the outer wall to thereby define means for holding the fluid;

a plurality of tubular member; and a base member secured to the bottom wall of the container for supporting said tubular members, said base member including a central opening and an inset portion on its underside in communication with a plurality of longitudinal openings circumferentially located around the base member whereby suction imparted on the tubular members by the persons causes the fluid to pass from the container through the central opening of the base member and its inset portion, and thereafter through the longitudinal openings into each of the tubular members thereby enabling more than one person to drink the fluid from the container simultaneously.

16. The container defined by claim 15 further comprising means for allowing fluid to flow through the tubular members only in one direction.

17. The container defined by claim 16 wherein the flow allowing means comprises a check valve for each of the tubular member.

18. The container defined by claim 15 further comprising a bracket member for positioning each of the tubular members with respect to the container.

* * * * *